US005134795A

United States Patent [19]

Wang

[11] Patent Number: 5,134,795

[45] Date of Patent: Aug. 4, 1992

[54] TRANSMISSION CONFIGURATION FOR CRYSTAL BALL HAVING SHAPE OF WIND MILL

[76] Inventor: L. F. Wang, No. 3, Alley 202, Kso-Fon Rd., Hsin-Chu City, Taiwan

[21] Appl. No.: 563,626

[22] Filed: Aug. 7, 1990

[51] Int. Cl.[5] ..... G09F 19/08

[52] U.S. Cl. ..... 40/411; 446/236; 84/95.2; 74/63; 472/6

[58] Field of Search ..... 40/411, 414, 423, 430, 40/440, 473, 409, 410; 475/11; 446/236, 265, 219; 272/31 R; 84/94.1, 94.2, 95.1, 95.2; 74/63; 464/157, 162, 185

[56] References Cited

U.S. PATENT DOCUMENTS

| | | | |
|---|---|---|---|
| 631,306 | 8/1899 | Hollingsworth | 272/31 R X |
| 1,102,148 | 6/1914 | Gawlik | 272/31 R |
| 1,323,902 | 12/1919 | Obolewicz | 446/236 |
| 1,389,372 | 8/1921 | Mitera | 446/236 |
| 1,427,296 | 8/1922 | Jakubiec | 272/31 R |
| 1,655,292 | 1/1928 | Przybylko et al. | 40/411 X |
| 1,839,881 | 1/1932 | Hyman | 40/473 |
| 2,512,465 | 6/1950 | Moorhouse | 40/473 X |
| 2,738,616 | 3/1956 | Windle | 446/219 X |
| 2,892,327 | 6/1959 | Kressin | 464/157 X |
| 4,356,658 | 11/1982 | Gold farb | 272/31 R X |
| 4,847,960 | 7/1989 | Hafla et al. | 475/11 X |

*Primary Examiner*—Kenneth J. Dorner
*Assistant Examiner*—Brian K. Green
*Attorney, Agent, or Firm*—Larson and Taylor

[57] ABSTRACT

Accordingly, the chief object of the present invention is to demonstrate a more impressive change of colors from the rotation of the blade containing fluids having different colors and central gravities in addition to the dynamic presentation of the decorative item within the main portion of the crystal ball of this invention by the main portion, blade of the windmill and the doll at the peripheral of the windmill respectively driven by the planetary gear disposed within the crystal ball for the configuration of transmission of crystal ball having shape of windmill.

6 Claims, 4 Drawing Sheets

TRANSMISSION CONFIGURATION FOR CRYSTAL BALL HAVING SHAPE OF WIND MILL

FIELD OF THE INVENTION

This invention relates to a crystal ball and in particular to a transmission for a crystal ball which contains an operating windmill.

SUMMARY OF THE INVENTION

In one embodiment, the transmission comprises planetary gears to drive a base on which the main portion of a windmill is mounted, the blade of the windmill, and figurines, such as a doll, disposed at the peripheral of the main portion of the windmill. In this way the windmill itself and the blade of the windmill rotate and spring, while the doll at the periphery of the windmill also rotates, thereby forming a beautiful landscape for this crystal ball decorative item. Furthermore, the blade is hollow and contains a fluid that is comprised of more than three different components, each having a different color and specific gravity. Thus during rotation, as a result of the flow of these fluids of different colors, a colorful variation can be produced and thereby significantly improve the visual enjoyment from this crystal ball according to the present invention.

BRIEF DESCRIPTION OF THE DRAWINGS

The present invention will become more readily apparent from the following description of the preferred embodiment of the present invention taken in conjunction with the accompanied drawings, in which.

DESCRIPTION OF THE PREFERRED EMBODIMENT

Figure 1:
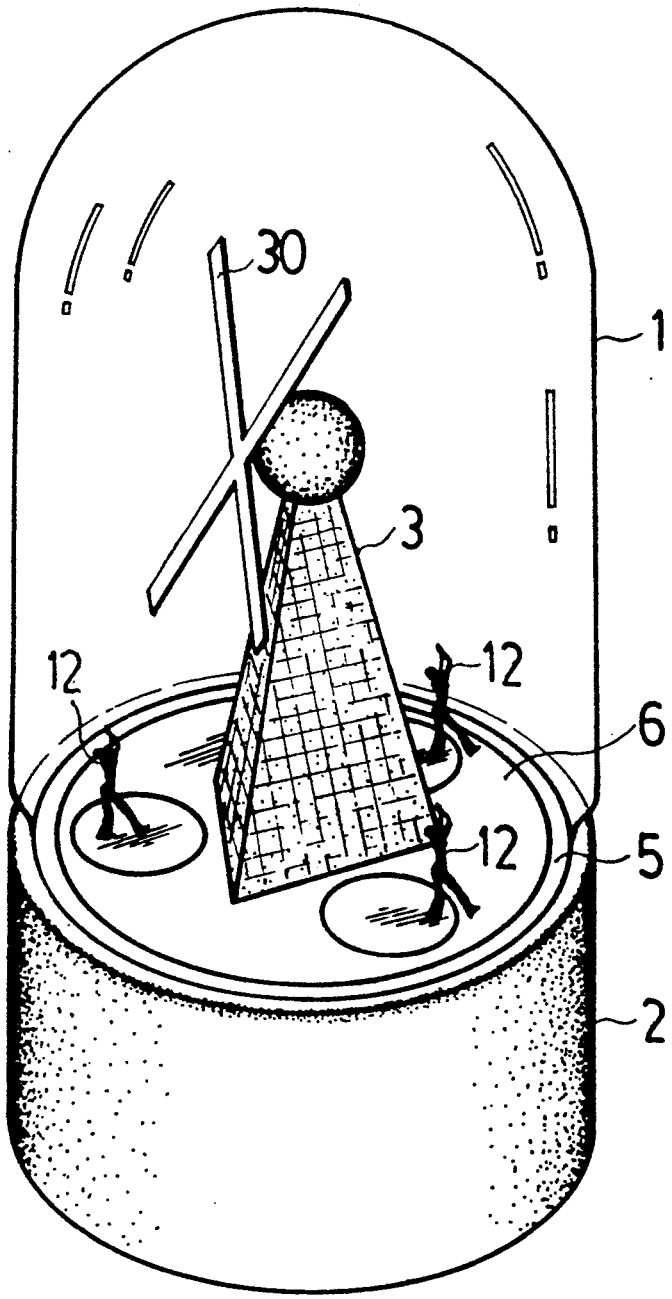
FIG. 1 is a perspective view of the outward appearance of a crystal ball according to the present invention.
Figure 2:
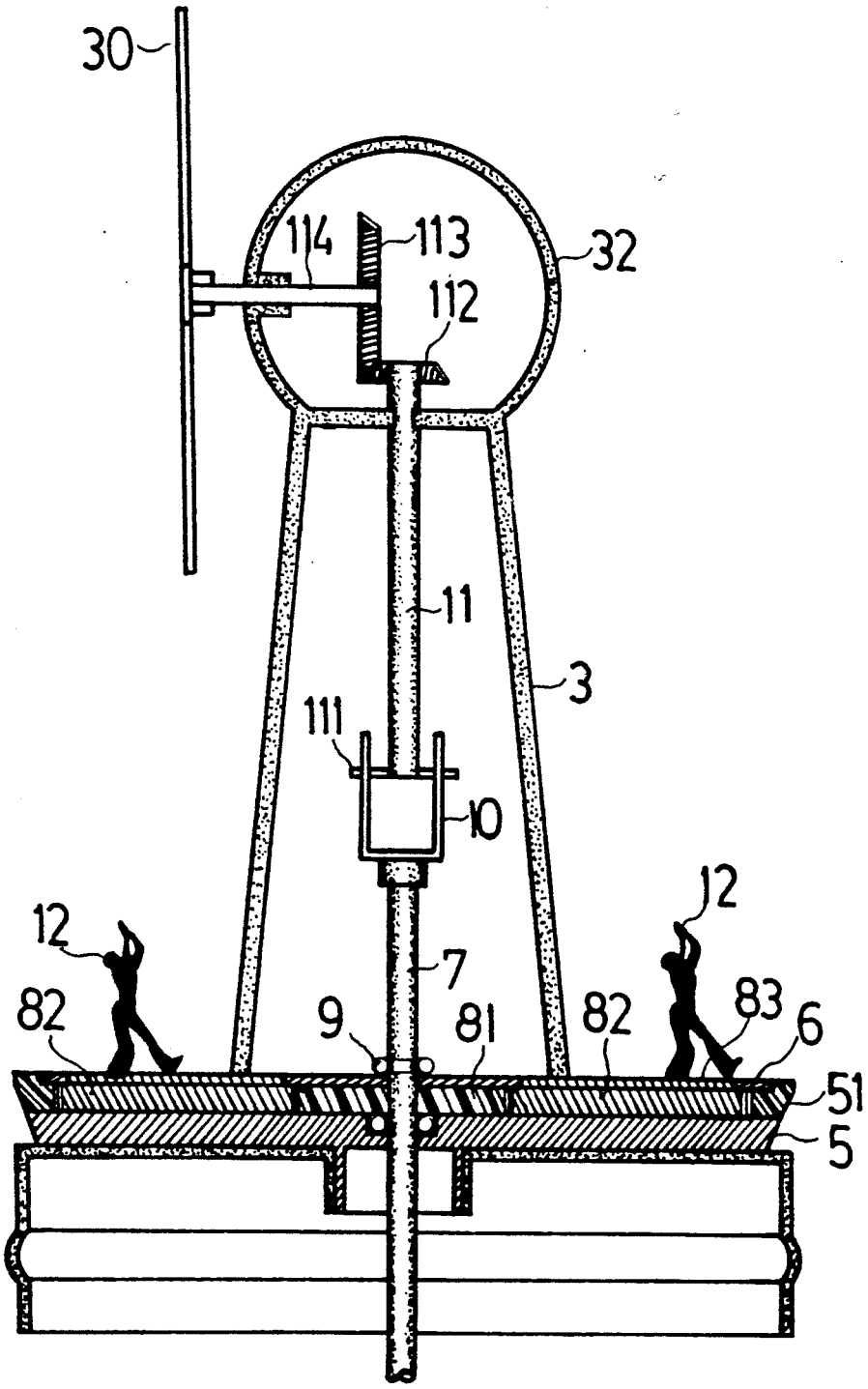
FIG. 2 is a side elevational cross-sectional view, with parts removed, of a windmill according to the present invention.
Figure 3:
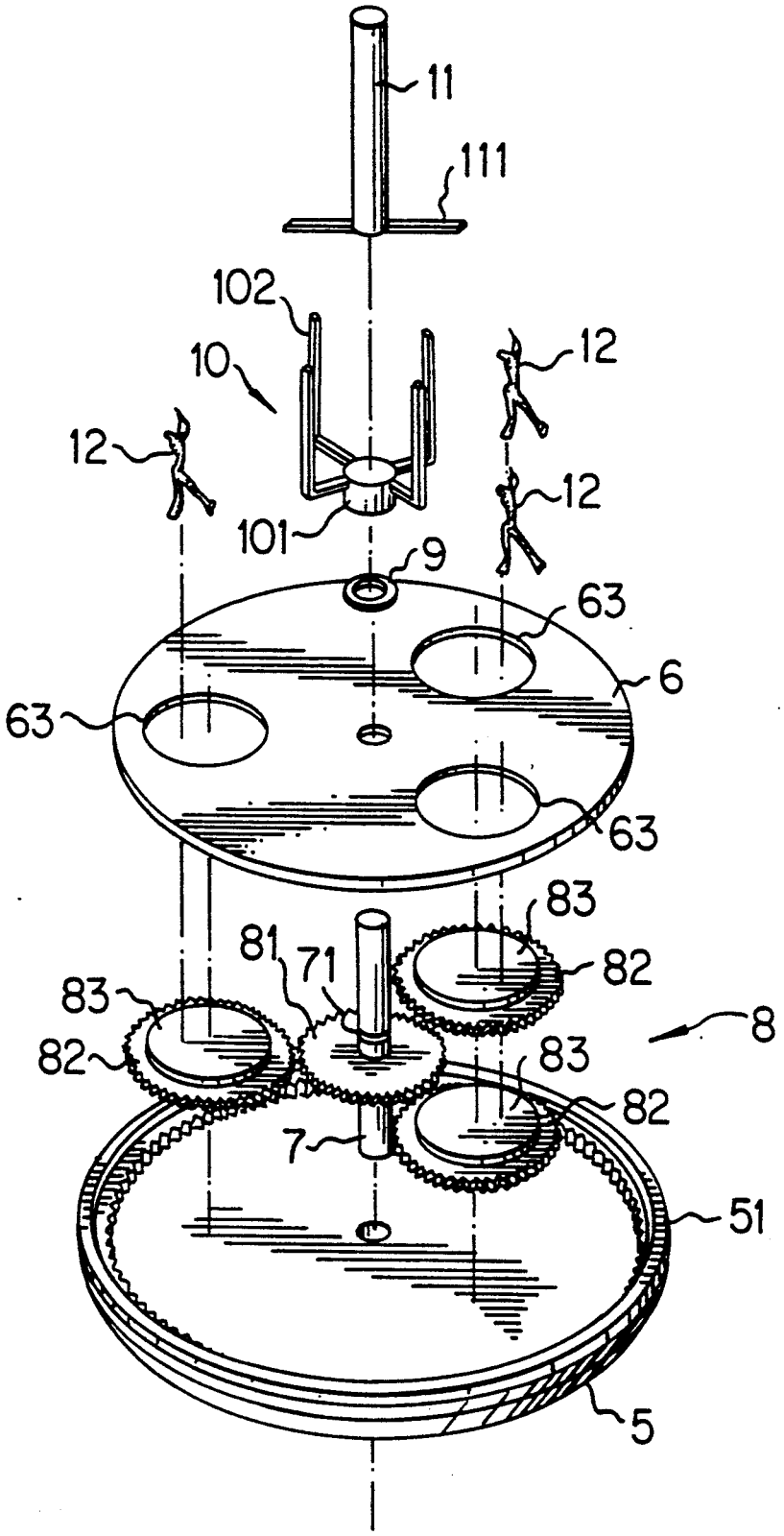
FIG. 3 is an exploded, perspective view of the drive assembly.

As illustrated in FIG. 1 of the accompanied drawings, there is depicted a crystal ball having a transparent cover 1 disposed above a wooden seat 2 with a fixed base 5 between wooden seat 2 and cover 1. A revolving or rotating disk 6 is located on the plane of fixed base 5 and is driven by a spring of a music box or bell mounted within wooden seat 2 (not shown). A drive train includes a central axle or shaft 7 and a planetary gearing 8 located between fixed base 5 and revolving disk 6. FIG. 2 & 3 illustrate the interconnection of planetary gearing 8, central axle 7 and revolving disk 6, described below.

A central gear 81 of planetary gearing 8 is mounted at the center of fixed base 5 and is fixed to central axle 7. A ring gear 51 is disposed of the periphery of fixed base 5. Between ring gear 51 and central gear 81 are equiangularly distributed planetary gears 82 with their cogs or teeth respectively engaged with those from ring gear 51 and those from central gear 81. By the aforesaid configuration, central gear 81 will revolve at the same speed as central axle 7 when driven by the music bell while planetary gears 82, being limited by the joint action of said central gear and ring gear 51 of fixed base 5, also have a common revolution around central axle 7. In addition, planetary gears 82 spin around on their own axes relative to central gear 81.

Furthermore, a circular, protruding disk 83, coaxial with a corresponding planetary gear 82, yet having a smaller diameter, is disposed on the upper surface of planetary gear 82. Also revolving disk 6, having a diameter slightly larger than the inner diameter of ring gear 51 of fixed base 5 is disposed both above said planetary gear 82 and above said central gear 81, forming an interior upper surface of ring gear 51. Revolving disk 6 is provided with three bores 63 having the same diameter as that of protruding disks 83 from the planetary gear 82 and located at corresponding axial positions above planetary gear 82. As illustrated in FIG. 2, the upper surface of revolving disk 6 is able to stay in the same plane as that of ring gear 51 due to the thickness of revolving disk 6. In addition, the thickness of the cog or teeth of planetary gearing 8 is equal to that of ring gear 51 of said fixed base 5. In this design a more attractive style can be maintained.

Through the coordination from planetary gearing 8 and revolving disk 6, revolving disk 6 will rotate around central axle 7 using it as its spindle, as a result of being push from the motion generated from the common revolutions of planetary gears 82. These planetary gears, driven by central gear 81, also rotate themselves and revolve around central axle 7. As a result of the action from the aforesaid configuration, generally the individual, but coordinated revolutions of planetary gears 82, as well as the rotation of revolving disk 6 are demonstrated.

Dolls 12 (as shown in FIG. 2) are fixed eccentrically on protruding disks 83 of planetary gear 82 and with the aforesaid motions produce a scene of revolving and dancing dolls around the center of the revolving windmill rotating around the central axle 7. The rotation of revolving disk 6 produces its own effects in conjunction with other structures in the crystal bal as will be described below.

A driven or passive vertical shaft 11 is rotated in the same direction as that of central axle 7 a the center of the main portion of windmill 3. A lateral bar 111 is attached laterally at the bottom end of passive shaft 11 and has a length that is longer than that of the range to be encompassed by a finger 102 of a flexible grip 10. Lateral bar 111 is located at the midsection of the length of finger 102 of flexible grip 10, so that passive shaft 11 can be spinning, as driven by flexible grip 10 and lateral bar 111, while the drive of said flexible grip 10 and the lateral bar 111 provides central axis 7 a smooth transmission to passive shaft 11 even if there is certain bias or expansion in the length or the axial position of central axle 7 and passive shaft 11.

Furthermore, an active, or drive, oblique gear 112 is disposed at the top end of passive shaft 11 to drive a passive oblique gear 113 connected to a lateral shaft 114 at one end thereof, the other end of shaft 114 being connected to blade 30 of windmill 3. Thus blade 30 will also spin around as axle 7 and shaft 11 turn.

Figure 4:
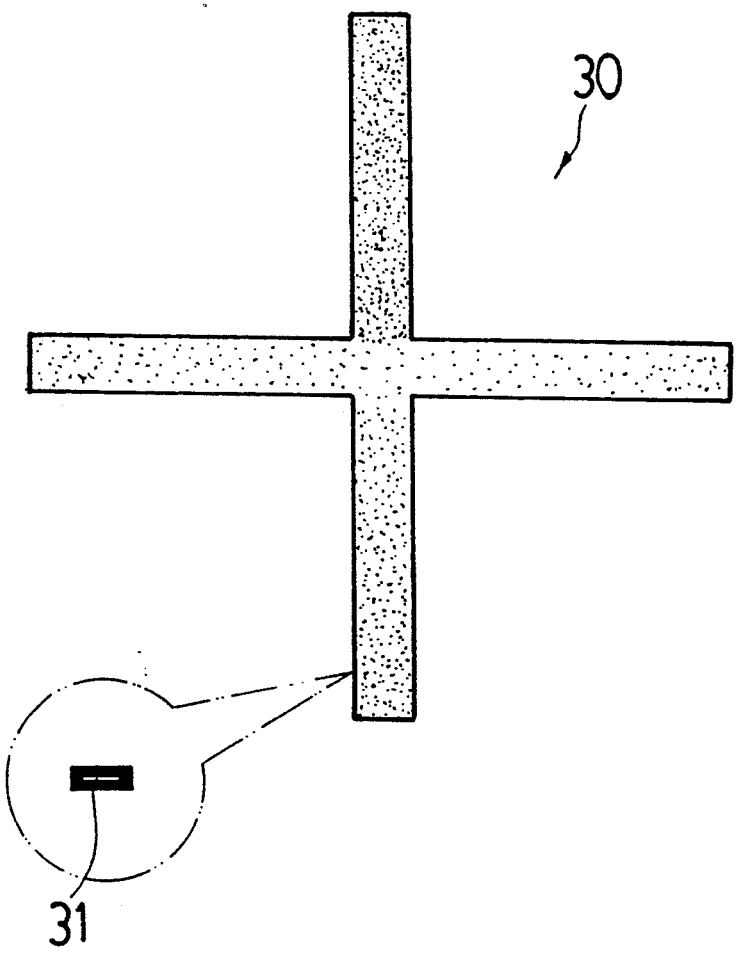
FIG. 4 is a plan view illustrating the blade of the present invention having a cross-sectional view of the blade in an insert.

In the present invention, blade 30 is designed as a hollow body 31, as illustrated in FIG. 4. In this way blade 30 of windmill 3 can have a greater, more colorful variation by containing different color fluids which have different specific gravities within hollow body 31. Once blade 30 begins to revolve, the fluids contained therein will start tumbling, depending on their positions, and thus display color changes, thereby creating a very unique presentation inside crystal ball 1.

Central axle 7, passive shaft 11, active oblique gear 112 and passive oblique gear 113 are contained within either the main portion or within the top 32 of windmill 3. The bottom of the main portion o windmill 3 is fixed onto revolving disk 6 as illustrated in FIG. 1. Therefore, once the revolving speed of the revolving disk 6 is identical to that of central axle 7, passive oblique gear 113 will not spin around, i.e. the blade will not rotate because the driving power from active oblique gear will be neutralized. As a consequence, in order to insure that both blade 30 and main portion of windmill 3 will revolve, different revolving speeds are provided by central axle 7 and rotating disk 6. The distribution of speeds arise from the ratio between that of planetary gear 82 and that of central gear 81 from planetary gearing 8.

To sum up, in addition demonstrating the simultaneous revolution of the main portion and blade 30 of windmill 3 as well as the rich changes in colors from the blade of the windmill, the present invention also exhibits the view of dolls dancing around the windmill. This display constitutes a very unique and attractive type for innovative crystal balls.

What is claimed is:

1. In combination, a crystal ball and a transmission configuration therefor in which said crystal ball includes a cover, a support base on which the cover is mounted, and a rotatable windmill that includes rotatable windmill blade, the transmission comprising a fixed base having a periphery and being mounted on the support base, said fixed base including a ring gear mounted at the periphery thereof, said ring gear having a top surface;

a revolving disk located above said fixed base and having an upper surface and a plurality of equiangularly distributed bores therethrough, the windmill being mounted on said revolving disk upper surface;

a central axle extending vertically through said fixed base and having a lower end and an upper end, said central axle being rotated at the lower end and including a flexible transmission mounted at the upper end;

a planetary gearing located between said fixed base and said revolving disk comprised of a central gear connected to said central axle, and a plurality of planetary gears equiangularly distributed between said central gear and said ring, each said planetary gear having an upper surface and protruding disk mounted on said upper surface thereof, each planetary gear corresponding to one of said bores and said protruding disks extending into said bores;

a vertically oriented driven shaft having an upper end and a lower end, said driven shaft being rotated by said flexible transmission at the lower end thereof and including a first oblique gear mounted at the upper end thereof; and a lateral shaft connected at one end to said windmill blade and including a second oblique gear mounted at the other end of said lateral shaft and engaged with said first lateral gear whereby upon the rotation of said central axle, said flexible transmission and said central gear, said flexible transmission rotates said driven shaft, which in turn rotates said windmill blade through said oblique gears and said lateral shaft, and said central gear rotates said planetary gears, whereupon the corresponding protruding disk is rotated, and whereupon through the coaction with said ring gear which is stationary, said planetary gears revolve around said central axle and, through said protruding disks, revolve said revolving disk.

2. The crystal ball and transmission configuration as claimed in claim 1 and further including a doll disposed at an eccentric position on said protruding disk.

3. The crystal ball and transmission configuration as claimed in claim 1 wherein said planetary gears are disposed between and respectively engage said central gear and said ring gear.

4. The crystal ball and transmission configuration as claimed in claim 1 wherein the thickness of said ring gear is equal to that of said revolving disk plus that of said planetary gears.

5. The crystal ball and transmission configuration as claimed in claim 1 wherein said flexible transission comprises four spaced apart fingers mounted at the upper end of said axle and a lateral bar mounted at the lower end of said driven shaft; and wherein said lateral bar is disposed at the mid portion of said fingers.

6. The crystal ball and transmission configuration as claimed in claim 1 wherein the revolving disk is driven by said protruding disks and the revolving speed of said revolving disk is controlled by the ratio between said central gear and said planetary gears.

* * * * *